US009821896B2

(12) United States Patent
Aasebö et al.

(10) Patent No.: US 9,821,896 B2
(45) Date of Patent: Nov. 21, 2017

(54) PROPULSION UNIT FOR MARITIME VESSEL INCLUDING A NOZZLE EXHIBITING A CURVED FOLLOWING EDGE AT THE OUTLET OF THE NOZZLE

(71) Applicant: Rolls-Royce Marine AS, Aalesund (NO)

(72) Inventors: Steinar Aasebö, Gursköy (NO); Leif Vartdal, Ulsteinvik (NO)

(73) Assignee: Rolls-Royce Marine AS, Aalesund (NO)

( * ) Notice: Subject to any disclaimer, the term of this patent is extended or adjusted under 35 U.S.C. 154(b) by 302 days.

(21) Appl. No.: 14/398,509

(22) PCT Filed: Apr. 26, 2013

(86) PCT No.: PCT/NO2013/050075

§ 371 (c)(1),
(2) Date: Nov. 3, 2014

(87) PCT Pub. No.: WO2013/169116

PCT Pub. Date: Nov. 14, 2013

(65) Prior Publication Data

US 2015/0093241 A1 Apr. 2, 2015

(30) Foreign Application Priority Data

May 8, 2012 (NO) ..... 20120526

(51) Int. Cl.

| | |
|---|---|
| ***B63H 5/125*** | (2006.01) |
| ***B63H 5/15*** | (2006.01) |
| *B63H 5/14* | (2006.01) |

(52) U.S. Cl.
CPC ..... *B63H 5/15* (2013.01); *B63H 5/125* (2013.01); *B63H 5/14* (2013.01); *F05D 2240/128* (2013.01); *F05D 2260/98* (2013.01)

(58) Field of Classification Search
CPC .. B63H 5/15; B63H 5/125; B63H 5/14; F05D 2240/128; F05D 2260/98
(Continued)

(56) References Cited

U.S. PATENT DOCUMENTS 3,088,430 A 5/1963 Champney
3,707,939 A 1/1973 Berg
(Continued)

FOREIGN PATENT DOCUMENTS

DE 2744913 A1 4/1979
FR 2155163 A5 * 5/1973 ..... B63H 5/14
(Continued)

OTHER PUBLICATIONS

English translation of FR 2155163, translated by Espacenet.*
(Continued)

*Primary Examiner* — Woody Lee, Jr.
*Assistant Examiner* — Behnoush Haghighian
(74) *Attorney, Agent, or Firm* — Alix, Yale & Ristas, LLP

(57) ABSTRACT

Propulsion unit (11) for propulsion and maneuvering of a maritime vessel, which includes a nozzle (12) exhibiting a curved following edge (12) at outlet of the nozzle (12), which results in that length of the nozzle (12) is longer in upper part of the nozzle (12) and shortest at the outermost points of a horizontal central axis through the nozzle (12), when the nozzle (12) is seen from behind.

15 Claims, 9 Drawing Sheets

(58) Field of Classification Search
USPC ..... 415/111, 112; 416/189
See application file for complete search history.

(56) References Cited

U.S. PATENT DOCUMENTS

| | | | | | |
|---|---|---|---|---|---|
| 4,831,297 | A | * | 5/1989 | Taylor | B63H 23/24 310/87 |
| 5,220,231 | A | * | 6/1993 | Veronesi | B63H 1/16 310/90 |
| 5,252,875 | A | | 10/1993 | Veronesi et al. | |
| 5,607,329 | A | * | 3/1997 | Cho | B63H 1/16 310/266 |
| 5,722,866 | A | * | 3/1998 | Brandt | B63H 5/125 440/61 R |
| 5,890,937 | A | * | 4/1999 | Granger | B63H 5/14 440/67 |
| 6,837,757 | B2 | | 1/2005 | Van Dine et al. | |
| 2012/0093669 | A1 | | 4/2012 | Gieras et al. | |

FOREIGN PATENT DOCUMENTS

| | | | | | |
|---|---|---|---|---|---|
| GB | 1227354 | A | * | 4/1971 | B63H 5/14 |
| GB | 1600994 | | | 10/1981 | |
| GB | 1600994 | A | * | 10/1981 | B63H 5/14 |
| JP | 50-118492 | A | | 9/1975 | |
| JP | 51-87391 | U | | 7/1976 | |

OTHER PUBLICATIONS

International Search Report and Written Opinion dated Sep. 26, 2013 (PCT/NO2013/050075).

Second Written Opinion dated May 28, 2014 (PCT/NO2013/050075).

International Preliminary Report on Patentability dated Aug. 28, 2014 (PCT/NO2013/050075).

* cited by examiner

PROPULSION UNIT FOR MARITIME VESSEL INCLUDING A NOZZLE EXHIBITING A CURVED FOLLOWING EDGE AT THE OUTLET OF THE NOZZLE

BACKGROUND

The present disclosure relates to a propulsion unit for propulsion and maneuvering of a vessel, according to the preamble of claim 1. Especially, the invention relates to a propulsion unit provided with a nozzle exhibiting a curved following edge at the outlet of the nozzle.

There are known propulsion units including a propeller section which is fixed in a surrounding rotor part, in the periphery of which there are arranged permanent magnets or windings for providing magnetic field. The rotor part constitutes the rotor of an electrical motor and is positioned inside a surrounding stator part, which stator part is provided with magnetic devices or windings for generating magnetic field for causing rotation of the propeller section.

U.S. Pat. No. 5,220,231 discloses such a propulsion unit for a seagoing vessel. The propulsion unit has a centrally supported propeller section having propeller blades extending radially between a central part and a radially exterior positioned ring which rotates with a small radial distance from the stator part.

It is an increasing focus on reducing the power requirement for the use of all types of propulsion units for propulsion and maneuvering of a vessel. Higher demands regarding emission of environmentally unfriendly gases and fuel costs are increasing, something which have resulted in high focus on development of new solutions, among others, optimization of propeller blades and development of hybrid systems for propulsion of the vessels.

Another area where efforts have been made for improvement is on the nozzle of the propulsion unit.

GB1600994 discloses a fixed propeller nozzle having varying length extension of the nozzle through varying profile both on the inlet and outlet for the nozzle to exhibit reduced friction through improved hydrodynamic properties where the flow velocity is highest. Having a varying nozzle profile in front of the propeller, accordingly a curved inlet, will result in variations in the inflow to the propeller. Such a variation already exists from the hull and the solution in GB1600994 seeks to reduce this variation. Having such a varying nozzle inlet will require a lot of analyze work to adapt the nozzle inlet to a given hull. The same nozzle may on a different hull or application make bad matters worse. In other words, this solution is not adapted for mass production as it must be adapted to each vessel it is to be used on.

GB502564 describes a rotatable propeller nozzle which exhibits a varying length both in front and back of the nozzle, and exhibits a shape as an <<aircraft motor>> or ellipse-shaped to catch as much water as possible into the propeller.

It should be mentioned that it is most common to use a nozzle where a constant length is maintained around the entire nozzle, such as e.g. shown in U.S. Pat. No. 5,220,231. The main drawback with this is that the propulsion unit will require large space under the hull during rotation, and that it will result in a heavier propulsion unit.

It is therefore a need for providing a propulsion unit, preferably a rotatable propulsion unit, having lower weight compared to prior art, but which at the same time exhibits sufficient strength.

It is also a need for providing a propulsion unit exhibiting a larger inner space for supply of means for lubrication of bearing devices, something which the prior art does not solve.

It is further a need for providing a propulsion unit exhibiting improved properties for accommodating forces and vibrations than which is the case with prior art, which is especially present when the propulsion unit is pivoted out when the vessel is moving with high velocity.

It is common to use a permanent magnet motors in such propulsion units, something which results in that the nozzle in principle exhibit limited material thickness, which creates a need for a more solid nozzle to maintain an acceptable stress level in the material.

SUMMARY

The disclosed device provides a propulsion unit for propulsion and maneuvering of a vessel which solves the mentioned disadvantages of prior art.

The propulsion unit exhibits increased strength for handling hydrodynamic forces which affect a propulsion unit like this.

The propulsion unit maintains an acceptable stress level for materials in nozzle and fastening devices for the nozzle to the hull of the vessel or steering devices.

The disclosed device provides a propulsion unit having lower weight compared to prior art, and at the same time exhibiting sufficient strength.

The propulsion unit exhibits improved properties and increased safety for supply of lubrication means to hub and bearing devices, compared to prior art.

The disclosed device provides a propulsion unit which requires less space during rotation under the hull.

The disclosed device provides a propulsion unit which exhibits increased inner volume compared to prior art, which can be utilized for arrangement of more solid stays and increased supply of lubrication means.

The disclosed device provides a propulsion unit for propulsion and maneuvering of maritime vessels, which propulsion unit is adapted for fastening to hull of the vessel or a steering device arranged for rotating the propulsion unit 0-360 degrees, a limited number of degrees, pivotable movement of the propulsion unit, swinging the propulsion unit in/out of the hull of the vessel or similar. This is e.g. a vertical rotating thruster, also known as an azimuth thruster.

The propulsion unit includes a nozzle wherein a propeller section being electrically or hydraulically driven is arranged for propulsion and maneuvering of the vessel.

The present invention seeks to provide a propulsion unit having simpler, larger and safer supply of lubrication means to hub and bearing devices in connection with the propeller, such as shaft sealing and bearing devices. Lubrication like this must be performed through stays both in front and back of the propeller.

All the stays behind the propeller have as a task to transfer the large propeller forces from the propeller shaft to the nozzle, before the forces go further upwards. It is advantageous that it is arranged a stay which extends mainly vertically downwards behind the propeller for accommodating most of these forces, as the forces in any case shall further upwards. The largest force is the axial propeller thrust, acting in axial direction, and for transferring this it is advantageous that the profile of the stay is long in axial direction. For achieving this, the nozzle must be provided with extra length in upper part of the nozzle, behind the propeller.

As mentioned above, lubrication means are to be supplied down to the hub and bearing devices, something which is simplest to perform through the stay which extends mainly vertical down from the upper part of the nozzle. To achieve this it is required that the stay has a larger inner volume than the other stays which only will be arranged to accommodate forces. For the stay to act hydrodynamic in the intense water flow behind the propeller, it is important to hold the thickness/cord length ratio of this stay low. It will thus say that when it becomes thicker to exhibit larger inner volume, it should also be longer. For achieving this, the upper part of the nozzle must exhibit extra length behind the propeller.

There are large hydrodynamic forces affecting a propulsion unit like this. There are large forces from the propeller, but also large forces from the nozzle. Mentioned can especially be lateral forces when the propulsion unit is pivoted out while the vessel is having high velocity. As the propulsion unit is only fixed and supported at the top by means of a fastening device, and no support below, such as rudders often have, all these forces must be transferred from the nozzle through the fastening device, and further up in the hull or steering devices for the propulsion unit. As this type of propulsion units can include, among others, a permanent magnet motor, material thickness of the nozzle, in principle, is limited. In the connection between nozzle and fastening device it is thus required higher material thickness for transferring the forces and at the same time maintaining an acceptable stress level in the materials of the nozzle and fastening device. To achieve this, the nozzle must exhibit increased material thickness in upper part, and that one for holding the thickness/cord length ratio of the nozzle low, must increase the length of the nozzle in upper part.

An alternative to this, which is used in prior art, is to maintain a constant large length around the entire nozzle, but this is burdened with several disadvantages, among others, the propulsion unit will then require more space under the hull when rotating, and this will also result in a heavier propulsion unit.

Propulsion units like this generally include a fastening device in the form of a stem extending from an upper surface of the nozzle and up in the hull of the vessel or to steering devices. In the patent application of the applicant with title "Propulsion unit for maritime vessel", filed 2012.14.03, it is described a fastening device which is formed by two stems extending in parallel or laterally reversed about an vertical central axis from an upper surface of the nozzle of the propulsion unit ending in a fixing flange for therethrough to provide an opening which provides the propulsion unit with improved hydrodynamic performance. Such a fastening device is shown in FIGS. 5-8. When one have two stems like this between the nozzle and hull, the water will flow between these two stems. This water will be accelerated up to a higher velocity where the volume between the stems is lowest. When the volume between the stems again increases the water must be is decelerated corresponding to the volume increase. Such a deceleration has a tendency to result in rotation, backflow and turbulence in the water, which again will result in increased drag. It is thus important that this deceleration of water is performed as gently as possible. To achieve this it is important that the stems have a curvature so that the distance between the stems gently increases after the shortest distance. Another measure is to extend the nozzle backwards in upper part so that the nozzle slowly is curving down in the area between the stems.

Another moment which is important for rotatable propulsion units is that they require as little space as possible in connection with rotation (azimuth). To minimize the space needed for rotation (azimuth) it is preferable that the following edge at the outlet of the nozzle is shortened at the outermost points seen along a horizontal central axis through the nozzle, when the nozzle is seen from behind. This is due to that the azimuth axis is some arranged forward to reduce steering moment, and that it thus is the following edge of the nozzle that is space demanding during rotation.

For the nozzle to exhibit sufficient strength, the lower part of the nozzle is preferably extending some longer, preferably at the bottom point of the nozzle. If it is a desire that the propulsion unit should have as low weight as possible, the nozzle preferably has shorter length at the bottom part than at the upper part of the nozzle.

The disclosed device is not limited to a central bearing solution, as mentioned above, as the propulsion unit also can include a periphery-supported propeller section, i.e. a bearing device where the stationary part of the bearing device is fixed to stator and the rotating part of the bearing device is fixed to rotor.

In other words, the disclosed device provides a propulsion unit having a nozzle exhibiting a curved following edge at the outlet of the nozzle, where the length of the nozzle is longest at the upper part of the nozzle and shortest at the outermost points of a horizontal central axis through the nozzle, when the nozzle is seen from behind. It is further preferable that the length of the nozzle at lower part of the nozzle also is some longer than the shortest length. In this way the nozzle exhibits a curved following edge which results in that the nozzle is longest at the upper part of the nozzle and extends with decreasing length towards the outermost points of a horizontal central axis through the nozzle, for next to exhibit increasing length towards the bottom part of the nozzle which has some longer length than the shortest length of the nozzle.

With the disclosed propulsion unit, there is achieved larger inner space in upper part of the nozzle so that one can arrange simpler, larger and safer supply of lubrication means to hub and bearing devices, e.g. by that one can arranged stays having larger inner volume. One achieves larger space for arranging more solid and stronger stays for accommodating forces so that one maintains an acceptable stress level in the materials of the nozzle and fastening device, something which will result in increased operating time and safety. One achieves further reduced space when the propulsion unit is rotated under the hull, lower steering moment is required for rotating the propulsion unit due to lower lateral forces affecting the propulsion unit, and that one achieves a lighter propulsion unit. This will result in that the propulsion unit can be dimensioned for lower steering moment. The lower steering moment the propulsion unit must be dimensioned for the smaller propulsion unit, something which will result in a cheaper propulsion unit.

By providing the propulsion unit with a curved following edge of the nozzle this will not result in more variation in the load of the propeller than what is normal, and this will thus not affect noise and vibrations, and at the same time one achieves the above mentioned advantages.

Further features and details of the disclosed device will appear from the following description.

BRIEF DESCRIPTION OF THE DRAWINGS

The present device will below be described in further detail with references to the attached drawings, where.

DETAILED DESCRIPTION

Figure 1:
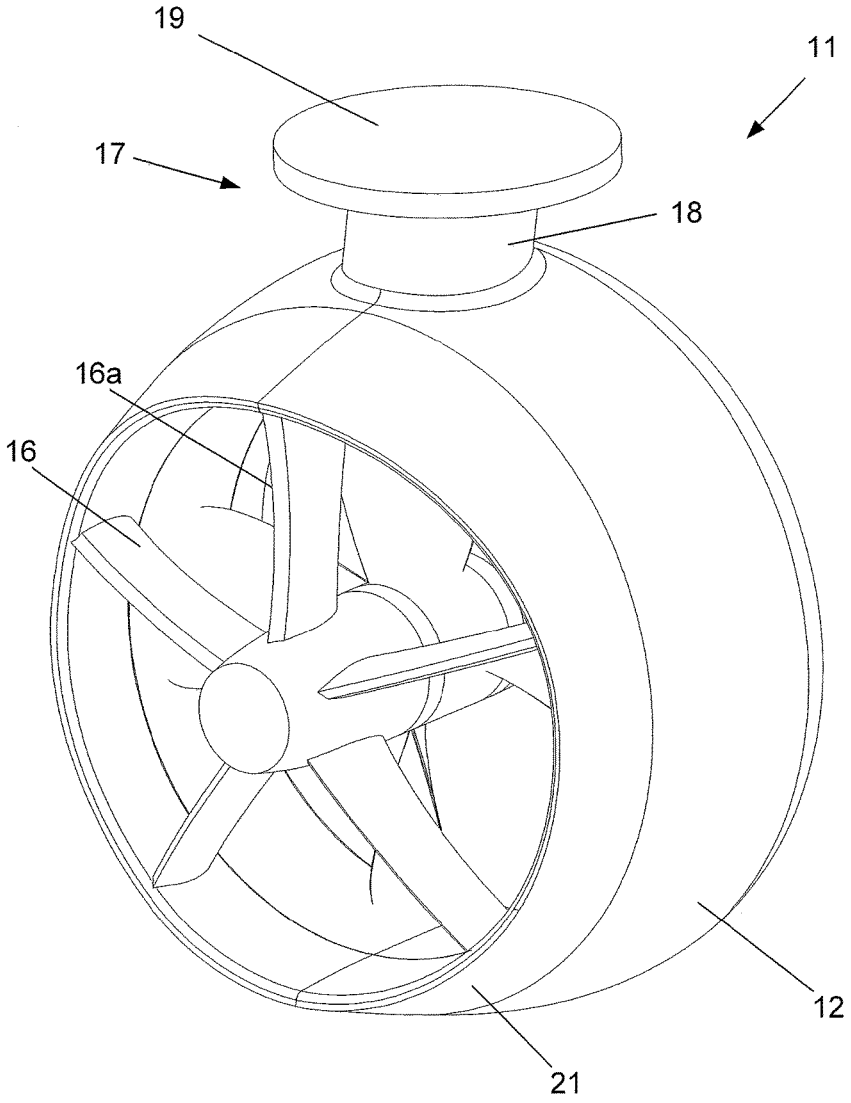
FIG. 1 shows a perspective drawing, seen inclined from behind, of a propulsion unit for propulsion and maneuvering of a maritime vessel, according to a first embodiment.
Figure 2:
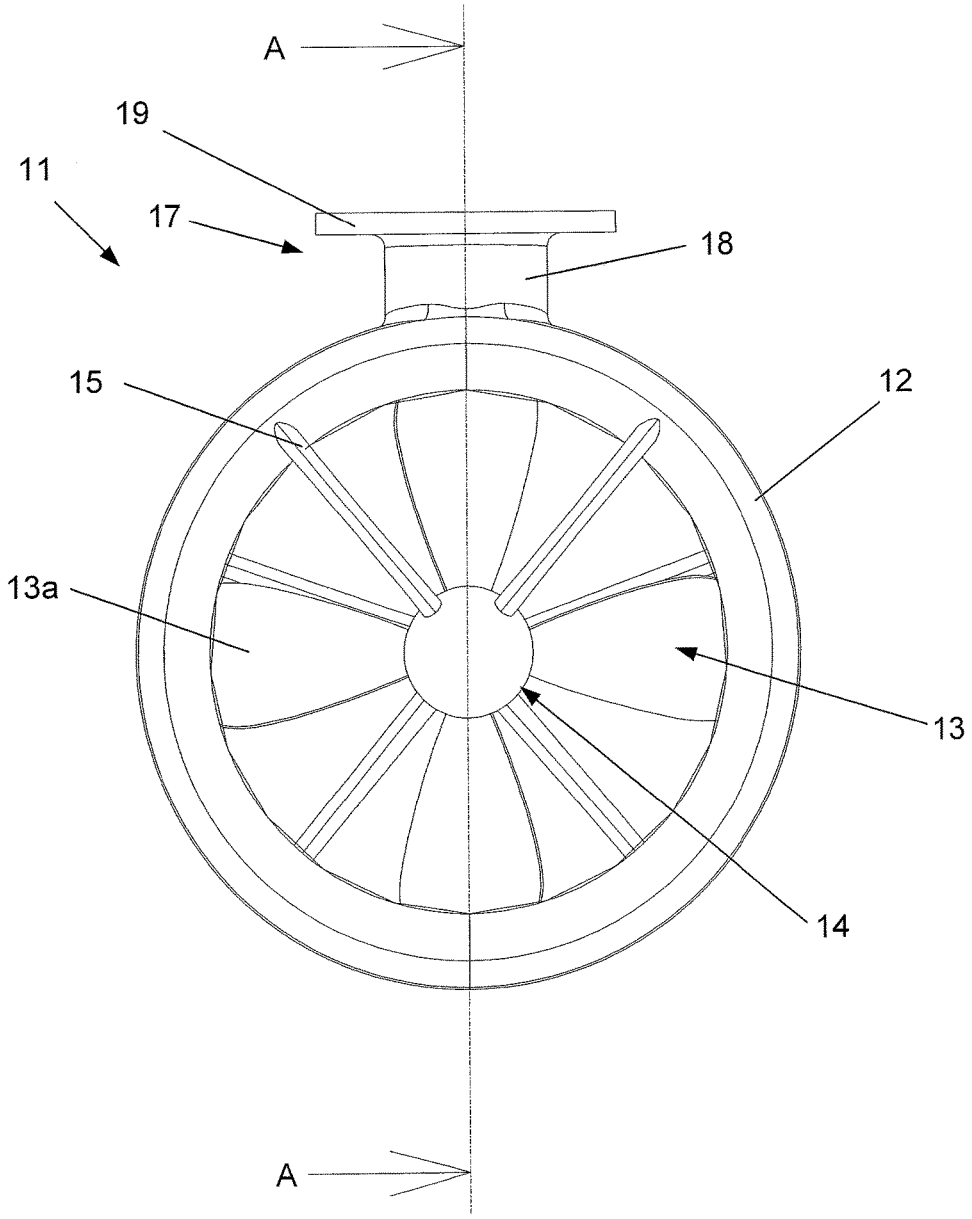
FIG. 2 shows a front view of the propulsion unit in FIG. 1.

Reference is now made to FIGS. 1 and 2 which show a first embodiment of a propulsion unit 11 for propulsion and maneuvering of a maritime vessel for arrangement to hull of the vessel or a steering device arranged for rotating the propulsion unit 0-360 degrees, tiltable movement, swinging the propulsion unit out/in of the hull of the vessel or similar. The propulsion unit 11 includes a tubular nozzle 12 having a propeller section 13 having a central hub 14 rotatably supported in the nozzle 12 by means of stays 15, 16, arranged in front and behind the hub 14, respectively, fixed to the nozzle 12. In the shown embodiment there are use four stays 15 in front and five stays 16 behind, but the number of stays in front and behind can of course be different from this. The main function of the stays 15, 16 is to accommodate forces.

As can be seen in FIG. 2 the propeller section 13 includes four propeller blades 13*a*, but it can of course include more or fewer propeller blades. The propeller blades 13*a* extend mainly radially between the central hub 14 and an annular rotor part (not shown) surrounding the propeller section 13, and to which the propeller blades 13*a* are fixed. The annular rotor part is rotatably arranged inside a stator part (not shown), preferably in a recess in the nozzle 12 so that the rotor parts are positioned outside the flow of water through the nozzle 12. A number of permanent magnets are arranged to the outer periphery of the rotor part. The permanent magnets are positioned a short distance from a plurality of windings fixed to the stator part, in such a way that magnetic fields for force application onto the magnets can be generated by supplying electric current in the windings, for controllable and regulated rotation of the rotor part, and hence also the propeller section 13. Between the exterior surface of the rotor part and an opposite inner surface of the stator part, there will be a gap which will be filled with water when the propulsion unit 11 is submersed in water. There also exist solutions which utilize gas for replacing the water in the gap for achieving reduced loss in the gap. These features are well known within the technique.

The propulsion unit 11 is further provided with a fastening device 17 for arrangement of the propulsion unit 11 to hull of the vessel or steering device as mentioned above. The fastening device 17 for a propulsion unit 11 according to the invention includes in the first embodiment a stem 18 being arranged to an upper surface of the nozzle 12 by means of suitable fastening means (not shown) and which is provided with a fixing flange 19 at the side which is to be connected to a fastening point on the hull or a steering device. As will be shown later the fastening device 17 can also include two stems 18*a-b* (FIG. 5).

Figure 5:
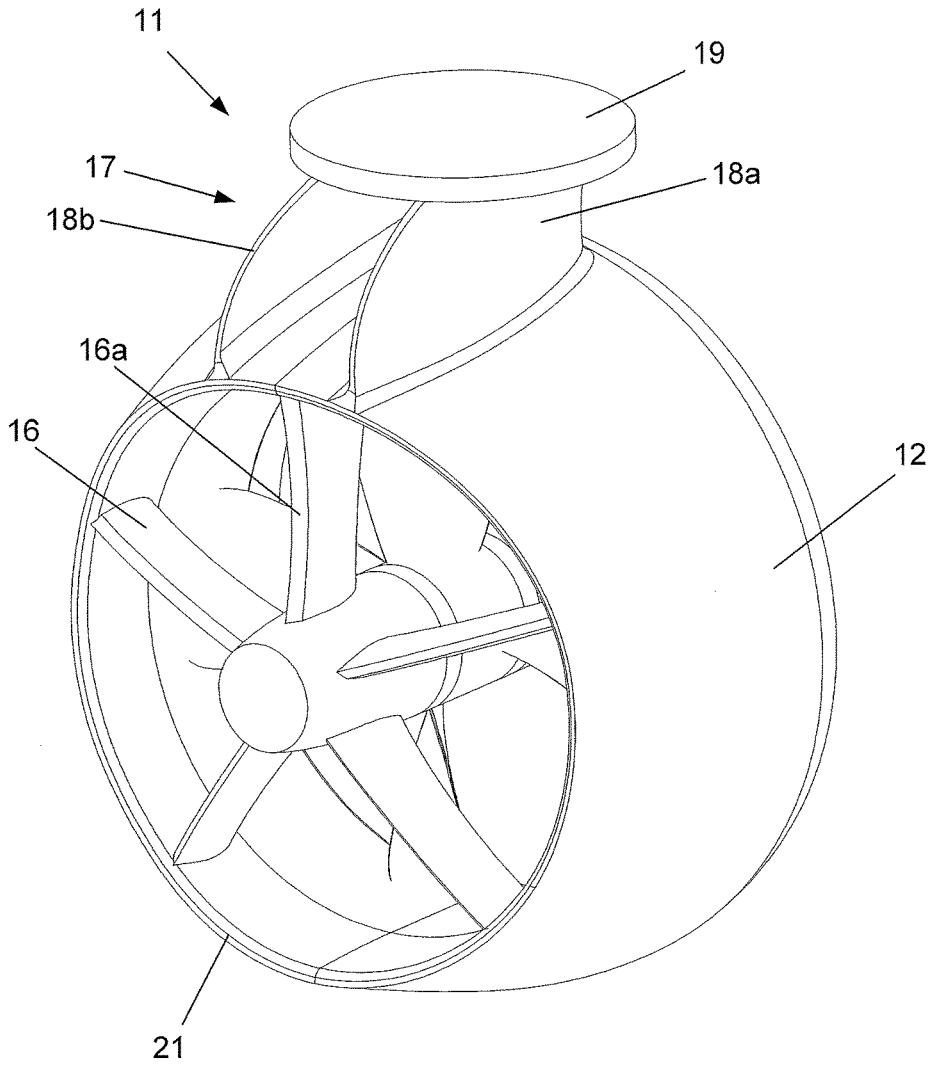
FIG. 5 shows a perspective view, seen inclined from behind, of a propulsion unit for propulsion and maneuvering of a maritime vessel, according to a second embodiment.
Figure 6:
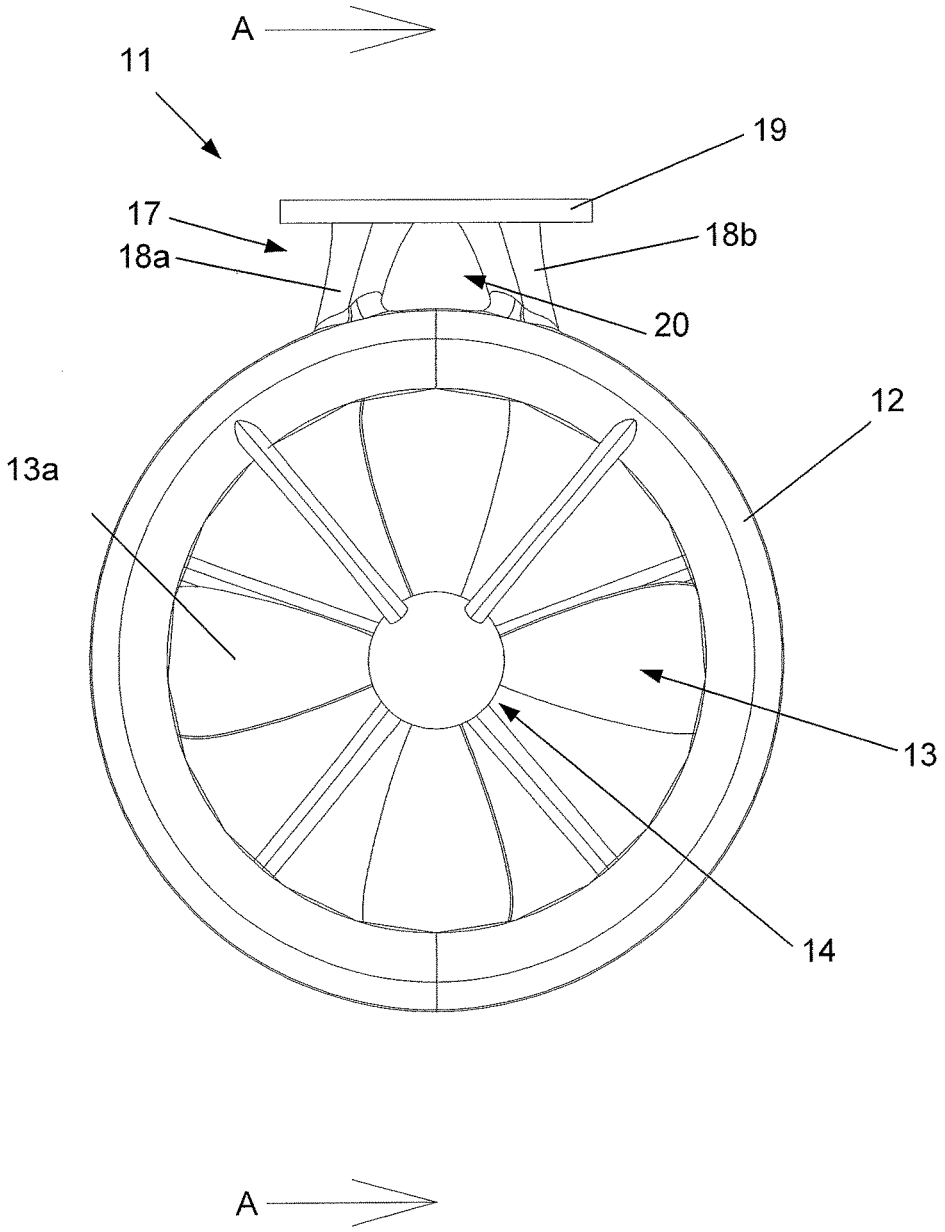
FIG. 6 shows a front view of the propulsion unit in FIG. 5.

Reference is now made to FIG. 5 which shows a second embodiment of a propulsion unit 11. In the second embodiment the fastening device 17 includes two stems 18*a-b* arranged to an upper surface of the nozzle 12 by means of suitable fastening means (not shown), which stems 18*a-b* extend laterally reversed or in parallel about an vertical central axis (coincident with cross-sectional axis A-A indicated in FIG. 6), up from the nozzle 12 and ending in a fixing flange 19.

The stem 18 of the first embodiment and the stems 18*a-b* of the second embodiment preferably have a design which corresponds to a wing- or rudder-shape so that they are hydrodynamically optimal, so that they do not result in unnecessary turbulence, noise or vibrations.

In the solution with two stems 18*a-b*, the stems 18*a-b* and the fixing flange 19 will form an opening 20 (FIG. 6) above the nozzle 12 for allowing flow of water passing the outside of the nozzle 12.

It is further advantageous that the stem 18 of the first embodiment and the stems 18*a-b* of the second embodiment are arranged with a distance from the front of the nozzle 12 to avoid water which passing on the outside of the nozzle 12 from meeting the stem(s) 18, 18*a-b* and is forced back and into the nozzle 12.

There are many advantages by using a fastening device 17 where two stems 18*a-b* ending in a fixing flange 19 are used so that a hydrodynamic opening 20 is formed. This will, among others, considerably reduce the generation of turbulent inflow at the top of the nozzle 12, something which will result in improved operating conditions for the propulsion unit 11 and due to this the propeller section 13 will achieve considerably improved efficiency, something which considerably will reduce the power requirement for powering the propulsion unit 11. Another advantage is reduced weight of the propulsion unit 11 by that there will be two stems 18*a-b* which will accommodate forces and vibrations such that one do not need a massive stem, and that these stems 18*a-b* together with the fixing flange 19 will provide a rigid construction. With only one stem, this will need to be dimensioned for all the forces and vibrations, something which thus will result in a heavier propulsion unit.

Figure 3:
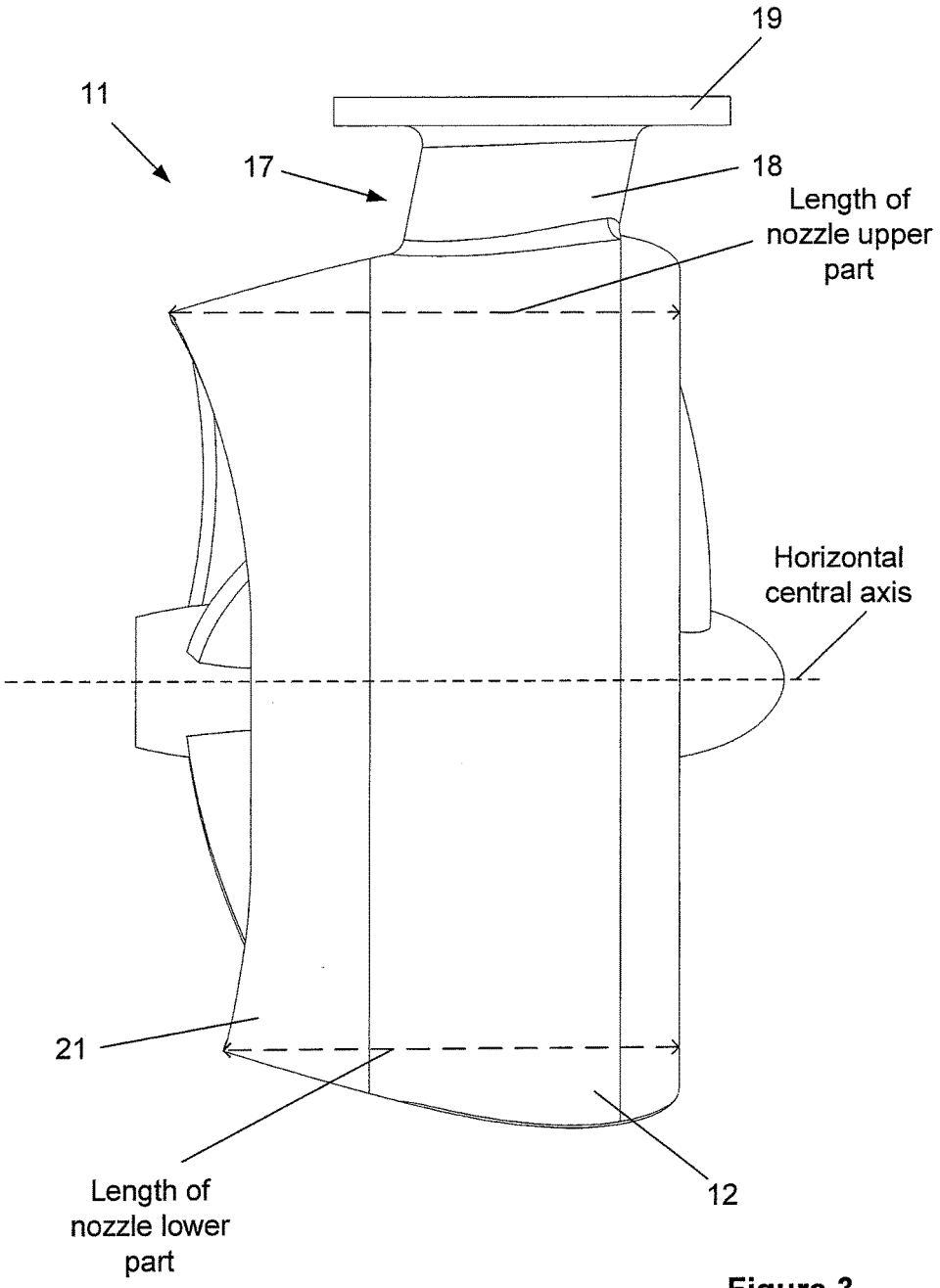
FIG. 3 shows a side view of the propulsion unit in FIGS. 1 and 2.
Figure 7:
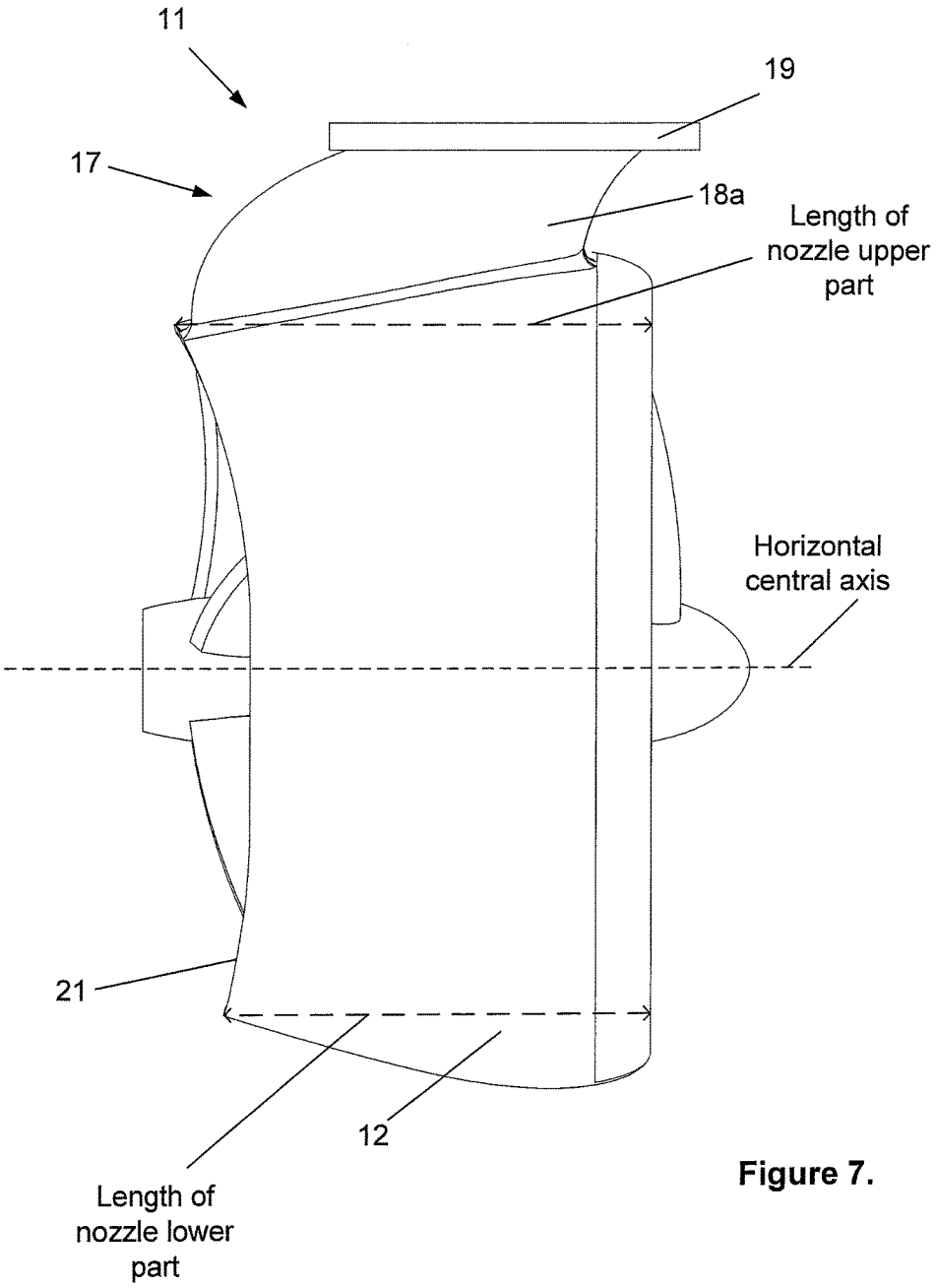
FIG. 7 shows a side view of the propulsion unit in FIGS. 5 and 6.

Reference is now made to FIGS. 1 and 3 for the first embodiment and FIGS. 5 and 7 for the second embodiment. The propulsion unit 11 includes a curved following edge 21 which results in that length of the nozzle 12 is longest at the upper part of the nozzle 12 and shortest at the outermost points of a horizontal central axis through the nozzle 12, when the nozzle 12 is seen from behind.

The increased length of the following edge 21 results in that there is provided more space in upper part of the nozzle 12, something which provides increased space for supply of lubrication means to the hub 14 and bearing devices, e.g. by that the increased space is utilized for arrangement of several or larger oil supply.

Supply of lubrication means down to the hub 14 and bearing devices can simplest be done by a stay 16*a* extending mainly vertical down from the upper part/upper point of the nozzle. For conveying several or a larger amount of lubrication means, such as oil, it is required that the stay 16*a* exhibits a larger inner volume in relation to the other stays 16. As the length of the upper part of the nozzle 12, behind the propeller section 13, is longer than for an ordinary nozzle, one can have a stay having larger inner volume, thicker/more solid and longer stay 16*a* than which is possible to achieve without the nozzle 12 exhibiting a loner upper part. It is also important that this stay 16*a* exhibits hydrodynamic properties in the intense water flow behind the propeller section 13, something which is achieved by holding the thickness/cord length ratio of the profile of the stay 16*a* low.

As the stays 16, 16*a* behind the propeller section 13 mainly have as main task to transfer the propeller forces from the propeller shaft to the nozzle 12, before the forces go further up, it is advantageous that the stay 16*a* which extends mainly vertical down from the upper part/point of the nozzle 12, behind the propeller section 13, accommodate as much as possible of these forces, as the forces in any case shall further upwards. The propeller thrust acting in axial direction is the largest force and the stay 16*a* thus exhibits a profile being long in axial direction, something which is possible by that the nozzle 12 exhibits extra length in upper part, behind the propeller section 13.

Figure 4:
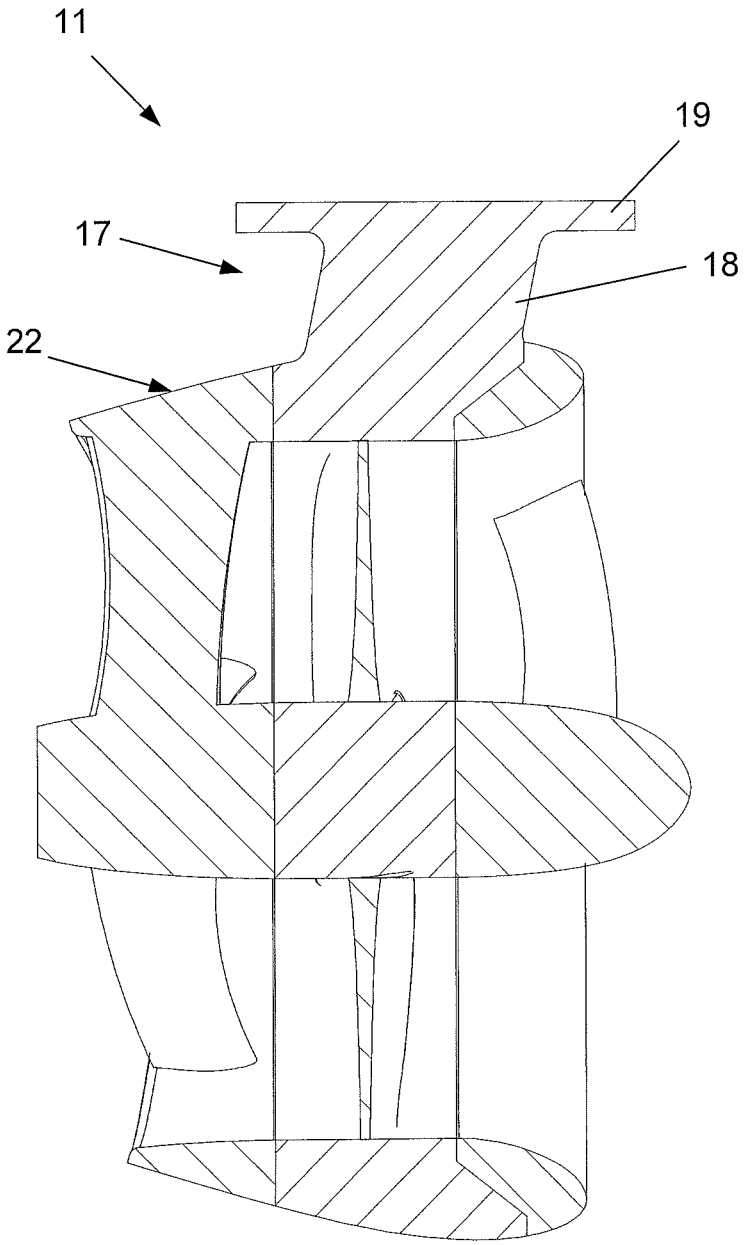
FIG. 4 shows a cross-sectional view of the propulsion unit in FIGS. 1-3, seen along line A-A in FIG. 2.
Figure 8:
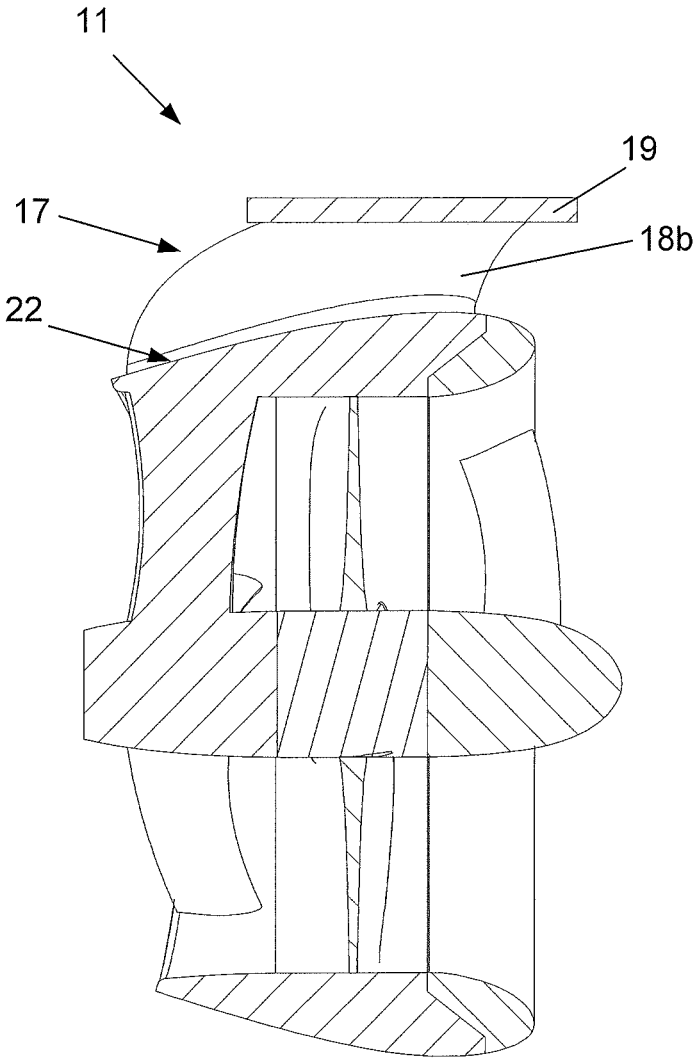
FIG. 8 shows a cross-sectional view of the propulsion unit in FIGS. 5-7, seen along line A-A in FIG. 6, and FIGS. 9*a-b* show views of the propulsion units in FIGS. 1 and 5, seen from above, which show the space required under the hull at rotation of the propulsion units about the azimuth axis.

There are also large hydrodynamic forces acting on a propulsion unit 11 like this, both from the propeller section 13 and from the nozzle 12, such as lateral forces when the propulsion unit 11 is swung out while the vessel is having high velocity. As the propulsion unit 11 only is arranged and supported in the top, all forces must be transferred from the nozzle 12 and up in the hull by means of the fastening device 17. In propulsion units 11 like this it is relatively common to use permanent magnet motors, something which results in that material thickness of the nozzle 12, in principle, is limited. It should be noted that there also exists other known solutions being an alternative to permanent magnet motors, such as hydraulic drive. To have an acceptable stress level in the material of the nozzle 12 and fastening device 17 requires increased material thickness for transferring the forces, which according to the invention is achieved by that the nozzle profile is thicker in the connection 22 (FIGS. 4 and 8) between the nozzle 12 and the fastening device 17. In addition to the profile of the nozzle 12 exhibiting increased material thickness, the nozzle 12 must also be some longer such that the thickness/cord length ratio is kept low. This is shown in FIG. 4 for the first embodiment and FIG. 8 for the second embodiment, respectively.

Figure 9A:
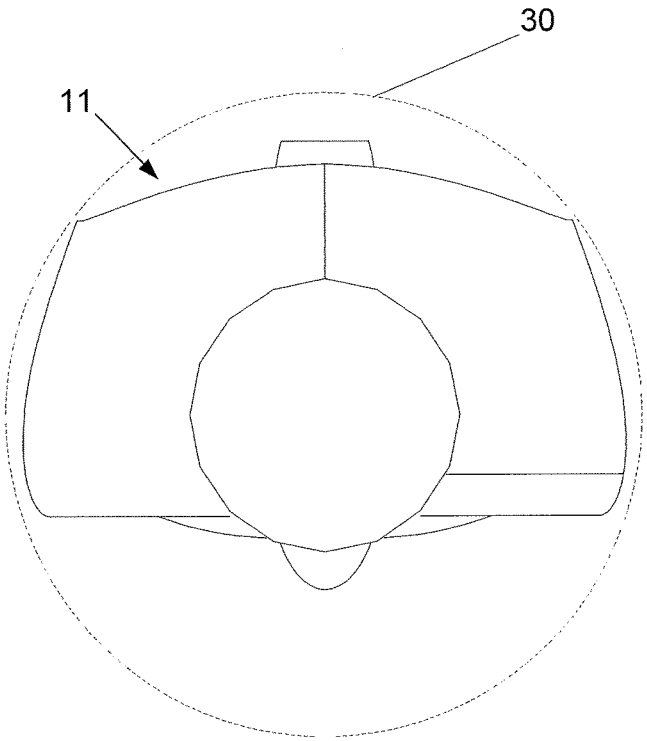
Figure 9B:
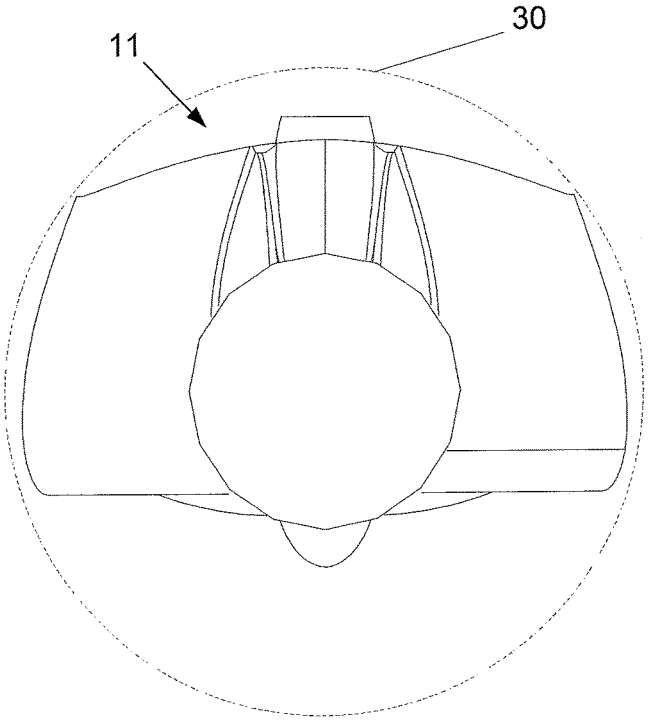

Another moment which is important for rotatable propulsion units 11 is that they require minimum space associated with rotation (azimuth), such as shown in FIGS. 9*a* and 9*b*, where an area 30 indicated by broken lines shows which area the propulsion unit 11 according to the invention requires. To minimize the area 30 which a propulsion unit 11 requires at rotation (azimuth), the curved following edge 12 of the nozzle 12 according to the invention is adapted so that the nozzle 12 exhibits shortest length in the outermost points seen along a horizontal central axis through the nozzle 12, when the nozzle 12 is seen from behind. This is a result of that the azimuth axis for the propulsion unit 11 is arranged some forward to reduce the steering moment, and it is thus the curved following edge 21 of the nozzle 12 which is space-demanding during rotation.

This results accordingly in that the propulsion unit 11 includes a nozzle 12 exhibiting a curved following edge 21, where the length of the nozzle 12 is longest at upper part of the nozzle 12 and shortest at the outermost points of a horizontal central axis through the nozzle 12, when the nozzle is seen from behind. For the nozzle 12 to exhibit sufficient strength the nozzle 12, at lower part of the nozzle 12, preferably also extends some longer than the shortest length. For saving weight the lower part of the nozzle preferably has a shorter extension than the upper part of the nozzle.

This means that the nozzle exhibits a curved following edge 21 which makes the nozzle 12 longest in upper part and extends with a decreasing length towards the outermost points of a horizontal central axis through the nozzle 12, for next to exhibit increasing length towards the bottom part of the nozzle 12.

Reference is now made to FIGS. 5-8 showing a propulsion unit 11 according to the second embodiment. By that the fastening device 17 in the second embodiment includes two stems 18*a*-*b* water will flow in the opening 20 between these. This will result in that the water will be accelerated up to a higher velocity where the volume between the stems 18*a*-*b* are lowest and decelerated correspondingly to the volume increase when the distance increases, something which results in rotation, backflow and turbulence in the water, which again results in increased drag. To prevent this, the propulsion unit 11 according to the second embodiment includes two stems 18*a*-*b* having a curvature so that the distance between the two stems 18*a*-*b* gently increases after the shortest distance. In this way the area between the stems 18*a*-*b* will curve slower downwards in the area between the stems 18*a*-*b*. The stems 18*a*-*b* further extend the entire length out to the following edge 21 at the upper part of the nozzle 12.

The stems 18, 18*a*-*b* exhibit a curved shape so that they extend in direction of the inlet of the nozzle 12, so that a central point through the fixing flange 19 is positioned in front of the propeller section 13 of the propulsion unit. This will result in that lower steering moment is needed for rotating the propulsion unit.

The propulsion unit 11 will accordingly be adapted for arrangement to both a fastening device 17 having one stem 18 and a fastening device 17 having two stems 18*a*-*b*. Further, the fact that the nozzle 12 is elongated in upper part will result in that it is provided additional space for supply of lubrication means and increased strength of the nozzle. For the nozzle to exhibit sufficient strength the nozzle can also be extended in the bottom point. For that rotatable propulsion units like this shall require minimum space in connection with rotation (azimuth), the nozzle 12 further exhibits a nozzle length being shortened in the outermost points seen along a horizontal central axis through the nozzle 12, when the nozzle 12 is seen from behind. By this one achieves a nozzle having lower weight compared to prior art, and the above described advantages with increased strength and inner space.

The examples above show a propulsion unit having a central bearing solution, but the propulsion unit can also be provided with a periphery-supported propeller section, i.e. a bearing device where the stationary part of the bearing device is fixed to stator and the rotating part of the bearing device is fixed to rotor. An example of such a solution is described in the international patent application WO2010/134820 in the name of the applicant.

The invention claimed is:

1. A rotatable propulsion unit (11) for propulsion and maneuvering of a maritime vessel, comprising a nozzle (12) and a propeller section (13, 13*a*), which propeller section is electrically or hydraulically driven, a fastening device (17) engaged to a steering device arranged for steering and/or moving the propulsion unit (11), which propeller section (13) is rotatably arranged about a hub (14) being arranged to the nozzle (12) by means of stays (15, 16) and a longer stay (16*a*) being longer and more solid than the other stays (16), said nozzle (12) having a curved following edge (21) at the outlet of the nozzle (12), which results in that length of the nozzle (12) is longer at upper part of the nozzle (12) and shorter at the intersection with a horizontal central axis through the nozzle (12), and the longer stay (16*a*) extends mainly in a vertical direction between the hub (14) and the extended curved edge (21) of the nozzle at an upper part of the nozzle, and the longer stay (16*a*) is arranged to accommodate forces acting in an axial direction of the propulsion unit (11).

2. A propulsion unit according to claim 1, wherein the curved following edge (21) of the nozzle (12) results in that the length of the nozzle at bottom part of the nozzle (12) is extending longer than the shortest length at the outermost points of the horizontal central axis through the nozzle (12).

3. A propulsion unit according to claim 1, wherein the length of the nozzle (12) extends with decreasing length from the upper part to the outermost points of the horizontal central axis through the nozzle (12), and with increasing length from the outermost points of the horizontal central axis through the nozzle (12) to the bottom part of the nozzle (12).

4. A propulsion unit according to claim 1, wherein the length of the bottom part of the nozzle (12) is shorter than the length of the upper part of the nozzle (12).

5. A propulsion unit according to claim 1, wherein the propulsion unit is provided with an inner space provided by the nozzle (12) having an increased length in upper part of the nozzle (12), said inner space being used for supply of lubrication means to hub (14) and bearing devices of the propulsion unit.

6. A propulsion unit according to claim 1, wherein the nozzle (12), by means of the length of the upper part of the nozzle (12), provides a thicker nozzle profile at the connection (22) between the nozzle (12) and the fastening device (17) than around the remaining of the nozzle profile.

7. A propulsion unit according to claim 1, wherein the longer stay (16*a*) exhibits a larger inner volume than the other stays (16) to allow larger supply of lubrication means to hub (14) and bearing devices.

8. A propulsion unit according to claim 1, wherein the fastening device (17) is formed by one or two stems (18, 18*a*) which ends in a fixing flange (19), which one or two stems (18, 18*a-b*) have a design corresponding to a wing- or rudder-shape so that the one or two stems avoid unnecessary turbulence, noise or vibrations.

9. A propulsion unit according to claim 8, wherein the one or two stems (18*a-b*) extend in parallel or laterally reversed about a vertical central axis from an upper surface of the nozzle (12) of the propulsion unit, which one or two stems (18*a-b*) and fixing flange (19) form an opening (20).

10. A propulsion unit according to claim 8, wherein the one or two stems comprise two stems (18*a-b*), wherein the distance between the two stems (18*a-b*) increases from the fastening device (17) in direction of the curved following edge (21), and the two stems (18*a-b*) extend with decreasing height in vertical direction approximately the entire length out to the curved following edge (21) at the upper part of the nozzle (12).

11. A propulsion unit according to claim 8, wherein the one or two stems comprise two stems (18*a-b*), wherein the surface of the nozzle (12) in an area between the stems (18*a-b*) inclines downwards from the fastening device (17) towards the curved following edge (21) of the nozzle (12).

12. A propulsion unit according to claim 8, wherein the one or two stems (18, 18*a-b*) are arranged with a distance from an inlet of the nozzle (12).

13. A propulsion unit according to claim 8, wherein the one or two stems (18, 18*a-b*) exhibit a curved shape so that the one or two stems extend in direction of the inlet of the nozzle (12), so that a central point through the fixing flange (19) is positioned in front of the propeller section (13, 13*a*) of the propulsion unit.

14. A propulsion unit according to claim 1, wherein the propulsion unit includes a periphery-supported propeller section.

15. A propulsion unit according to claim 1, wherein the propulsion unit includes a centrally stored supported propeller section.

* * * * *